United States Patent [19]

Reece

[11] Patent Number: 4,475,694

[45] Date of Patent: Oct. 9, 1984

[54] AUTOMATIC TENSION CONTROLLER BALL CREEL

[75] Inventor: D. C. Reece, Clarksville, Va.

[73] Assignee: Burlington Industries, Inc., Greensboro, N.C.

[21] Appl. No.: 437,556

[22] Filed: Oct. 29, 1982

[51] Int. Cl.[3] ..... B65H 59/00; B65H 75/00

[52] U.S. Cl. ..... 242/54 R; 242/45; 242/75.5

[58] Field of Search ..... 242/66, 78.6, 78.7, 242/75.5, 75.51, 54 R, 54.4, 45; 200/61.18; 19/157

[56] References Cited

U.S. PATENT DOCUMENTS

| | | | |
|---|---|---|---|
| 1,681,498 | 8/1928 | Rice et al. | 19/157 |
| 1,720,118 | 7/1929 | Corey . | |
| 2,325,381 | 7/1943 | Edwards et al. . | |
| 2,354,952 | 8/1944 | Hornbostel . | |
| 2,597,133 | 5/1952 | Snyder . | |
| 2,671,617 | 3/1954 | Clerck . | |
| 2,757,880 | 8/1956 | De La Motte | 242/78.7 |
| 2,970,788 | 2/1961 | Warncke | 242/75.51 |
| 3,561,692 | 2/1971 | Henry | 242/66 |
| 3,930,523 | 1/1976 | Garcia . | |
| 4,146,190 | 3/1979 | Bond et al. . | |

*Primary Examiner*—Stuart S. Levy
*Assistant Examiner*—Katherine Jaekel
*Attorney, Agent, or Firm*—Cushman, Darby & Cushman

[57] ABSTRACT

The tension of a web or strand being unwound from or wound into a ball or roll is controlled in an advantageous manner. The apparatus is particularly related to a creel for feeding out slivers of wool from a plurality of balls of sliver. The apparatus comprises first and second parallel rotatable shafts, the first driven at a relatively fast speed and the second at a relatively slow speed, and first and second rollers coaxially disposed on the shafts and rotatably mounted with them, the roller for receiving a strand wound thereon. The rollers are coupled so that they rotate at substantially the same speed. A clutch, responsive to a control signal, is provided for selectively coupling a first roller to the first shaft to rotate the rollers at a fast speed, or to couple the second roller to the second shaft to rotate the rollers at a slow speed. A switch, responsive to tension in the strand, controls generation of the control signal to the clutch.

9 Claims, 7 Drawing Figures

AUTOMATIC TENSION CONTROLLER BALL CREEL

BACKGROUND OF THE INVENTION

1. Field of the Invention

The present invention relates to apparatus for controlling the tension of a web or strand being unwound from or wound into a ball or roll, and particularly for a creel for feeding out slivers of wool from a plurality of balls of sliver.

2. Description of the Prior Art

Creel mechanisms for concurrently unwinding a plurality of collections of material, such as ball tops of wool sliver to feed drawing machine or other utilization device, typically comprise a pair of generally parallel rollers, both coupled to a common drive mechanism so that they are rotated in the same direction at a substantially uniform speed. The rollers impart a rotational motion to the ball to unwind the material strand (e.g. sliver of wool) from the collection (e.g. ball) to feed the drawing machine. Typically, 10 to 24 wound balls of sliver are unwound by the same creel. However, since the balls are typically not of uniform density, unwinding the balls at the same speed, causes various of the balls to overfeed, often causing tangling and various others to underfeed often causing the strand to break, thus decreasing the efficiency of the operation.

In general, systems for controlling the tension of a web supplied from or to a storage reel are known. Examples, of such systems are described in U.S. Pat. Nos. 2,597,133 issued to F. D. Snyder on May 20, 1952 and 3,930,523 issued to M. Garcia on Jan. 6, 1976 and 4,146,190 issued to R. Bond et al on Mar. 27, 1979. For example, the Bond et al system utilizes two rollers driven in the same direction by a common sprocket and chain arrangement to wind a roll of material. Tension in the web is detected by a pivotally mounted spring biased dancer roll. The dancer roll is connected to a variable transformer, which effects a voltage variation in the power provided to and thus the torque provided by the drive motor of the device in accordance with the tension. Such systems are unduly complicated, and/or not readily adapted to accommodate concurrent feeding out of a plurality of balls.

Another example, of a take-up mechanism is described in U.S. Pat. No. 2,354,952 issued to L. Hornbostel on Aug. 1, 1944. The Hornbostel patent describes a paper winder which automatically maintains a desired drag on the material being wound to produce a uniformly hard roll of material. A pair of winding drums rotatably mounted in horizontally spaced relation receive a spool therebetween. One of the winder drums is directly driven by a prime mover, and serves to rotate the spool to roll a web of flexible material such as paper therearound. The other winder drum serves as a partial support for the spool and feeds the flexible material to the spool at a rate somewhat slower than the rate of rotation imparted by the first drum so that the paper will be tightly wound. A dynamic clutch or eddy current coupling is interposed between the slow drum and the driving mechanism so that the slow drum speeds up as the roll of paper being wound increases in size and weight, but never reaches the speed of the fast drum. The Hornbostel apparatus is unduly complicated and not readily adaptable for relatively light materials such as a ball top of wool, or for unwinding operations.

Another example of a tension control apparatus for winding rolls of web material is described in U.S. Pat. No. 1,720,118 issued July 9, 1929 to J. Corey. In the Corey apparatus a plurality of pairs of parallel rollers are provided, one pair associated with each roll of web. A separate drive motor is provided for each roller of each pair and the respective relative speeds of the individual rollers in each pair vary to control tension. Such an arrangement is unduly expensive.

SUMMARY OF THE INVENTION

The present invention provides a relatively simple apparatus for controlling the tension of a strand, such as slivers of wool, commuting between a wound collection, such as a ball top and a utilization device, such as a drawing machine. A respective set of generally parallel rollers are rotatably mounted to a frame and adapted to receive the collection (e.g. ball top). A mechanism is provided for coupling the rollers together so that both rotate at a substantially uniform speed. Drive means is provided to selectively effect rotation of the rollers at either a fast speed or a slow speed, in accordance with control signals applied to the drive means. A switch, responsive to tension in the strand generates control signals so that the rollers normally rotate at the second speed but are rotated at the first speed in response to a predetermined change in the tension of the strand.

The present invention also provides a relatively simple creel mechanism for concurrently winding or unwinding a plurality of wound balls of strand, requiring only a single drive mechanism. A respective set of generally parallel rollers, coupled together for rotation at a uniform speed, is provided for each ball to be unwound by the creel. The corresponding rollers of each set are rotatably mounted on common shafts rotating at different speeds, and a separate clutch mechanism is provided for each set of rollers to selectively couple the rollers to one or the other of the shafts in accordance with the tension of strand from the associated ball.

The clutch mechanism comprises, in accordance with another aspect of the invention, an electromagnetic clutch cooperating between the fast rotating shaft and the associated roller, and a ratchet mechanism cooperating between the other roller and the slower rotating shaft.

Tension is sensed by a momentary contact switch, such as, for example, a mercury switch, cooperating with a switch arm disposed for pivotal displacement in response to change in tension in the strand.

BRIEF DESCRIPTION OF THE DRAWING

A preferred exemplary embodiment of the present invention will hereinafter be described in conjunction with the appended drawing, wherein like numerals denote like elements and.

DETAILED DESCRIPTION OF THE PREFERRED EXEMPLARY EMBODIMENT

Figure 1:
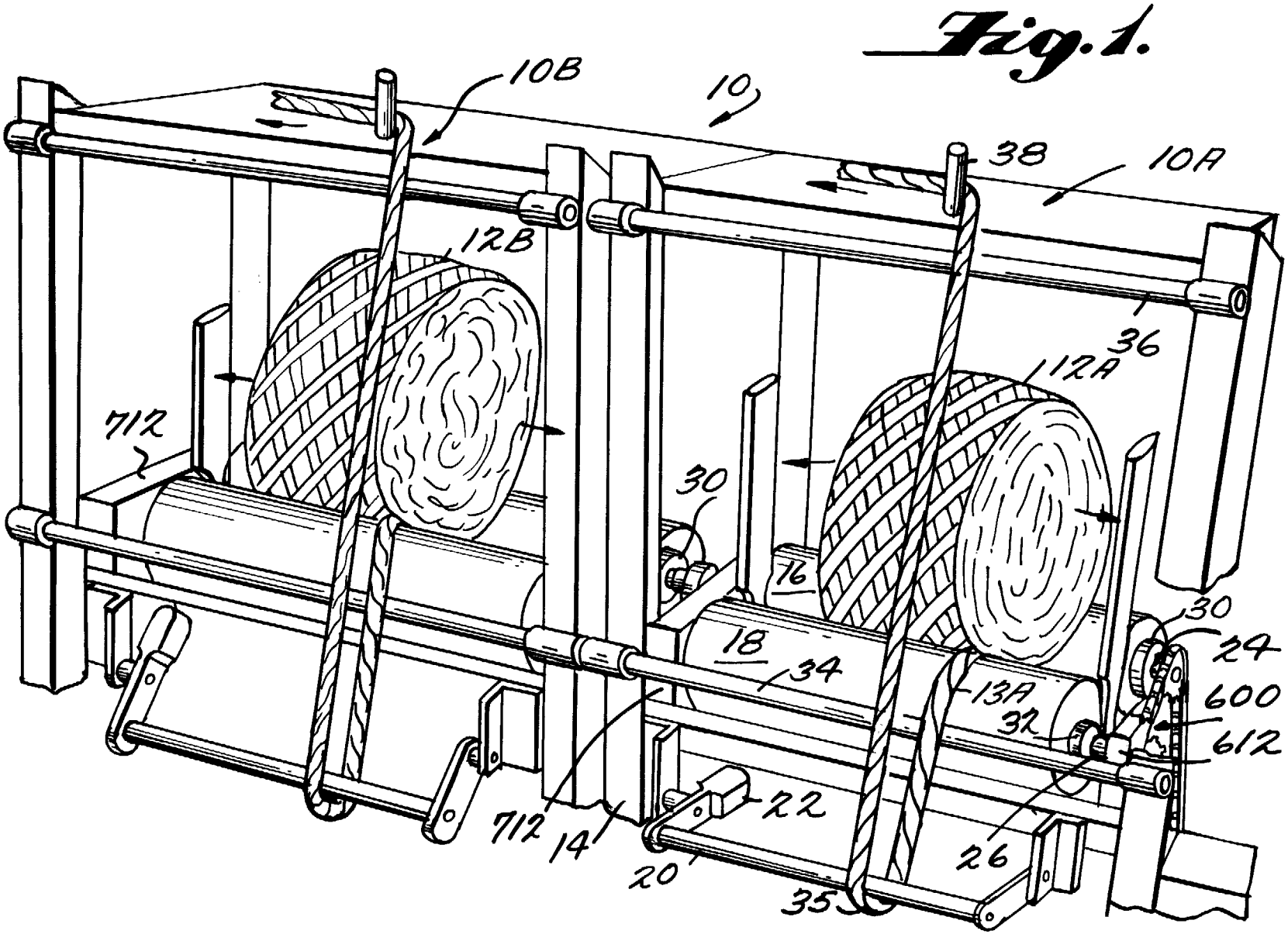
FIG. 1 is a perspective illustration of an apparatus in accordance with the present invention.
Figure 2:
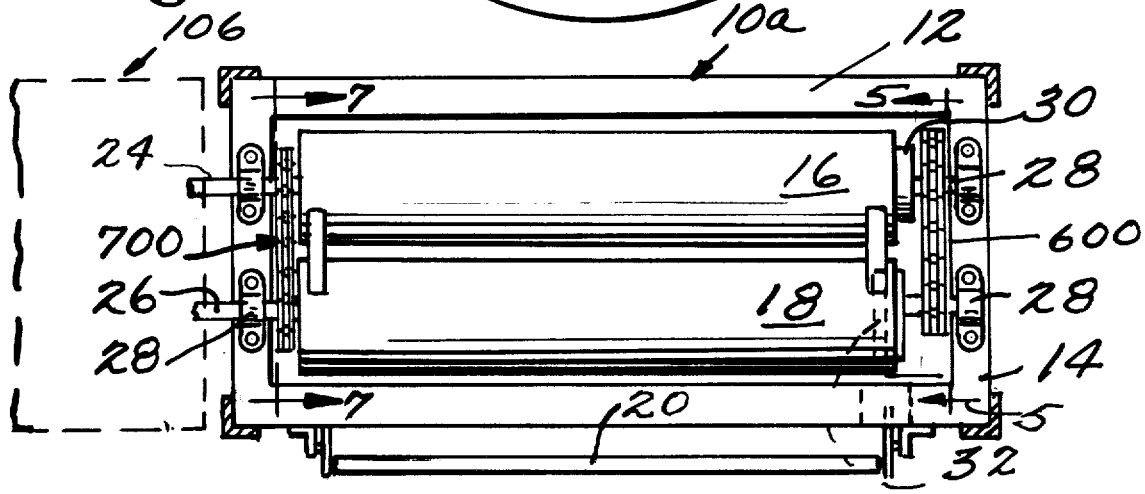
FIG. 2 is a top plan view of one section of an apparatus in accordance with the present invention.

Referring now to FIGS. 1 and 2, a creel apparatus 10 in accordance with the present invention comprises a plurality of sections 10*a*, 10*b*, each associated with an individual wound collection of strand 12*a*, 12*b*, such as ball tops of wool sliver. Each section comprises a frame 14, a set of first and second rollers 16 and 18, respectively, and a pivotally mounted switch arm (pivot rod) 20, cooperating with a momentary contact switch such as mercury switch 22.

Respective shafts 24 and 26, common to all of the section, are rotatably mounted on frames 14, by respective pillow blocks 28. As will hereinafter be more fully explained in conjunction with FIG. 6, shafts 24 and 26 are continuously rotated at predetermined first and second speeds, by a drive mechanism generally indicated as 600. Shaft 24 is suitably rotated at a somewhat higher speed than shaft 26.

Roller 16 of each section is coaxially disposed with respect to shaft 24 and rotatably mounted thereon. A respective conventional electromagnetic clutch 30, associated with each first roller 16, cooperates between the particular roller 16 and shaft 24, to selectively couple the individual roller 16 to shaft 24 for rotation. When clutch 30 is not engaged, roller 16 rotates freely and independently of shaft 24.

Similarly, the second roller 18 of each section is coaxially disposed with respect to shaft 26 and rotatably mounted thereon. A respective further clutch mechanism 32, associated with each roller 18, is also provided. Each clutch mechanism 32 cooperates between the associated roller 18 and shaft 26 to selectively couple the particular roller 18 to shaft 26. When clutch mechanism 32 is not engaged, roller 18 rotates independently of shaft 26. A suitable clutch mechanism 32 will hereinafter be described in conjunction with FIGS. 3, 4 and 6.

A coupling mechanism 700 between the first and second roller 16 and 18 of each set is provided so that the rollers rotate in the same direction at substantially uniform speeds. A suitable coupling mechanism 700 will be hereinafter described in conjunction with FIG. 7.

In operation referring to section 10*a* by way of example, ball 12*a* is disposed on rollers 16 and 18, and is rotated thereby in a direction opposite to the direction of rotation of the rollers, for feeding-out (unwinding) operation, rollers 16 and 18 rotate in a counter clockwise direction, causing ball 12*a* to rotate in a clockwise direction to feed out strand 13*a*. As will hereinafter be more fully explained, the strand is initially fed out in accordance with the slower speed of shaft 26, but is fed out at a faster speed in accordance with the speed of shaft 24 when an increase in tension of the strand is detected. A switch arm 20 and switch 22 cooperate to detect changes in tension in the strand. The switch arm 20 of the section is pivotally mounted to frame 14 to cooperate with the strand (e.g. sliver) drawn from the wound ball associated with the section. Strand 13*a* is suitably drawn off from ball 12*a* at the bottom of the ball, is passed outwardly over a guide rod 34, and turned in a downward direction. Strand 13*a* is then passed around switch arm pivot rod 20, to proceed in an upward direction, so that pivot switch arm 20 is, in effect, disposed within a loop 35 of the strand. Strand 13*a* is then passed inwardly over a further guide rod 36, around a guide post 38, and is directed to a drawing machine (not shown) or the utilization device.

Switch arm 20 actuates switch 22 in accordance with the tension of strand 13*a*. When the tension in strand 13*a* is within prescribed limits, pivot switch arm 20 is maintained in a predetermined position. However, when the tension of strand 13*a* increases, "slack" in the strand is decreased and loop 35 is drawn up, lifting pivot switch arm 20. The lifting of switch arm 20 from the predetermined position, actuates switch 22, which causes generation of an actuation signal to electromagnetic clutch 30 (electrical connections not shown). Accordingly, clutch mechanisms 30 and 32 are engaged in a mutually exclusive manner and cooperate so that during the operation of apparatus 10, either roller 16 is coupled to shaft 24 for rotation, and roller 18 rotationally independent of shaft 26 or shaft 18 is operatively coupled to shaft 26 for rotation and roller 16 rotationally independent of shaft 24. Electromagnetic clutch 30 is suitably a conventional SF 400 electric clutch, which is engaged in response to control signals applied thereto from switch 22. During periods when tension in strand 13*a* is above a predetermined level and accordingly the control signals are present, roller 16 is operatively coupled to shaft 24 for rotation at the relatively fast speed. When the tension is within the prescribed limits, clutch 30 is disengaged, and roller 16 rotates independently of shaft 24.

Clutch 32 suitably comprises a ratchet mechanism which couples roller 18 to shaft 26 for rotation at the relatively slow speed, but permits roller 18 to be rotated at faster speeds independently of shaft 26. Thus, when electromagnetic clutch 30 is disengaged, and roller 16 is rotatably independent of shaft 26, clutch 32 operatively couples roller 18 to shaft 26 for rotation at the relatively slow speed. Accordingly, roller 16 is also rotated at the relatively slow speed through operation of coupling mechanism 700. Conversely, when electromagnetic clutch 30 is engaged, causing roller 16 to rotate at the relatively fast speed of shaft 24, coupling mechanism 700 causes rotation of roller 18 at the relatively fast speed, overriding clutch 32 so that roller 18 rotates at the faster speed independently of the rotation of shaft 26.

In operation, rollers 16 and 18 rotate at the slower rotational speed of shaft 26. Accordingly, ball 12*a* is rotated in a counter clockwise direction to feed out strand 13*a* in accordance with the slower speed. If tension in strand 13*a* increases beyond a certain level, loop 35 draws up switch arm 20 to trip switch 22, which responsively generates a control signal to actuate clutch 30. Actuation of clutch 30 operatively couples roller 16 to shaft 24 for rotation at the faster speed. Coupling mechanism 700 then causes roller 18 to rotate at the faster speeds, overriding clutch 32. Ball 12*a* is then rotated in the counter clockwise direction at the faster speed to feedout strand 13*a* accordingly. The faster feedout of strand 13*a* decreases the tension of the strand, and ultimately creates a slack which is reflected in loop 35. When enough slack is accumulated in loop 35, pivot arm 20 is lowered and switch 22 deactivated. Accordingly, clutch 30 is disengaged and roller 16 rotates independently of shaft 24. In the absence of the driving of roller 18 by coupling mechanism 700, clutch 32 reengages and ball 12*a* is again rotated and strand 13*a* played out at the slower speed. If tension thereafter again increases to above the limit, loop 35 would again be drawn up to lift pivot arm 20 and trip switch 22 to actuate clutch 30 and effect fast playout to generate more slack. Thus, tension in strand 13*a* is controlled.

Figure 3:
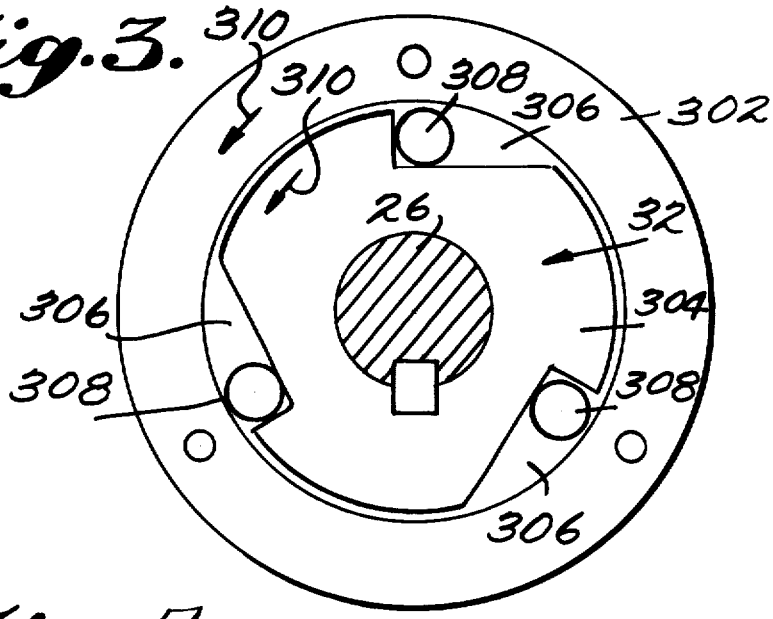
FIGS. 3 and 4 are schematic sectional side views of a ratchet clutch mechanism.
Figure 4:
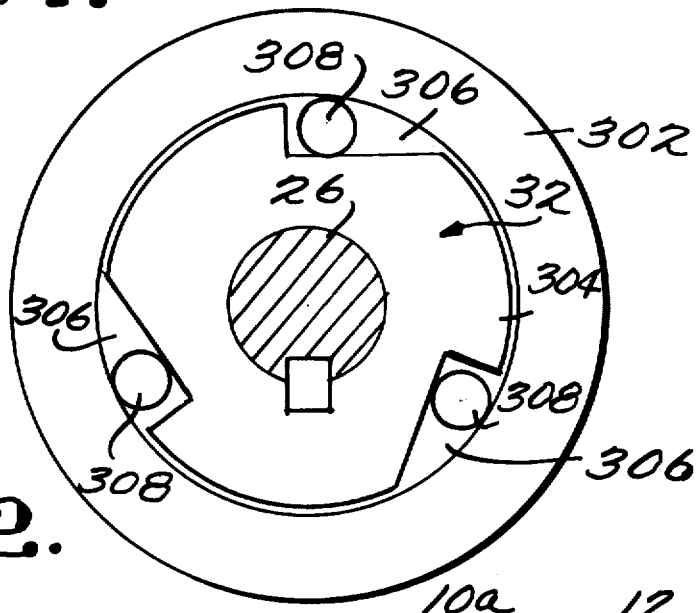
Figure 5:
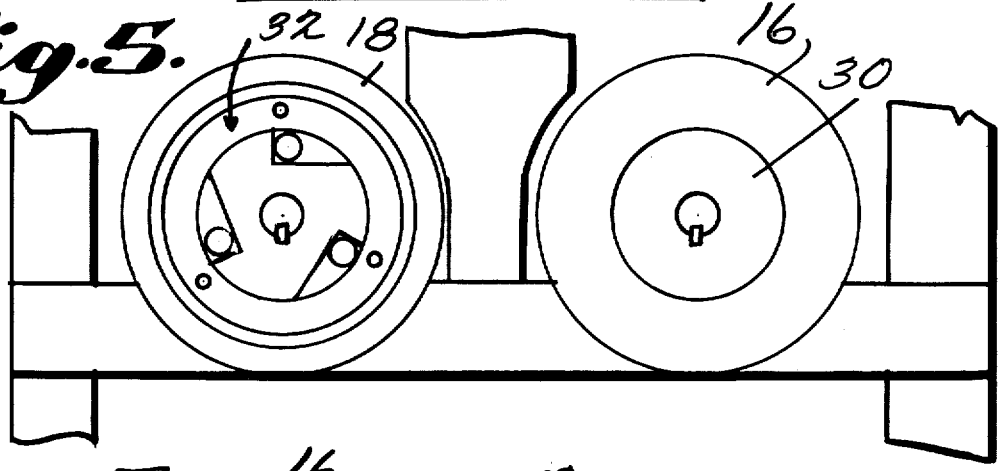
FIG. 5 is a sectional side view of the apparatus of FIG. 2 showing the ratchet clutch mechanism.

A suitable ratchet mechanism for use as clutch 32 is shown in FIGS. 3, 4 and 5. Ratchet mechanism 32 comprises outer and inner drive segments 302 and 304. Outer drive segment 302 is generally cylindrical and adapted for bolting to the end of roller 18. Inner drive segment 304, is received in the interior of the drive segment 302, and includes a central bore for receiving shaft 26. A key way is provided to insure positive coupling between shaft 26 and drive segment 304. Inner drive segment 304 is generally cylindrical and generally conforms in contour to the interior surface of outer drive segment 302. However, a plurality of oblique indentations (drive slots) 306 having a varying depth are provided in the outer periphery of inner drive segment 304.

Respective clutch rods 308 are disposed in drive slots 306, between inner drive segment 304 and outer drive segment 302. The diameter of clutch rods 308 is chosen relative to the depth of indentation 306 such that rod 308 does contact or barely contacts outer drive segment 302 when disposed in the deeper portion of the slot. However, when in the more shallow portions of the driving slot 306, rod 308 wedges between the respective drive segments causing outer drive segment 302 to be rotated with inner drive segment 304.

In operation, inner segment 304 rotates continuously counter clockwise (arrows 310) at the relatively slow speed of shaft 26. Absent of external drive through coupling mechanism 700, outer drive segment 302 (until engaged) is substantially non-rotating. Accordingly, inner segment 304 is moving faster than outer segment 302 and the relative motion causes rods 308 to roll in a clockwise direction, driving the rods into wedging relation between drive segments 302 and 304. Thus, absent of overdrive by coupling mechanism 700, outer segment 302 (and thus roller 18) is engaged for rotation by inner segment 304 (and thus shaft 26).

When, however, electromagnetic clutch 30 is engaged, clutch 32 is, in effect, overridden to permit roller 18 to rotate at the faster rate. When roller 16 is made to rotate at the faster speed of shaft 24, coupling mechanism 700 causes roller 18, and thus outer segment 302, to rotate in a counter clockwise direction at the faster speed. When outer segment 302 is rotating at a faster speed than inner segment 304, clutch rods 308 are, in effect, rolled into a deeper portion of driving slots 306, thus allowing outer segment 302 to rotate freely with respect to inner drive member 304. Accordingly, when electromagnetic clutch 30 is engaged, roller 18 rotates independently of the slower rotation of shaft 26.

Figure 6:
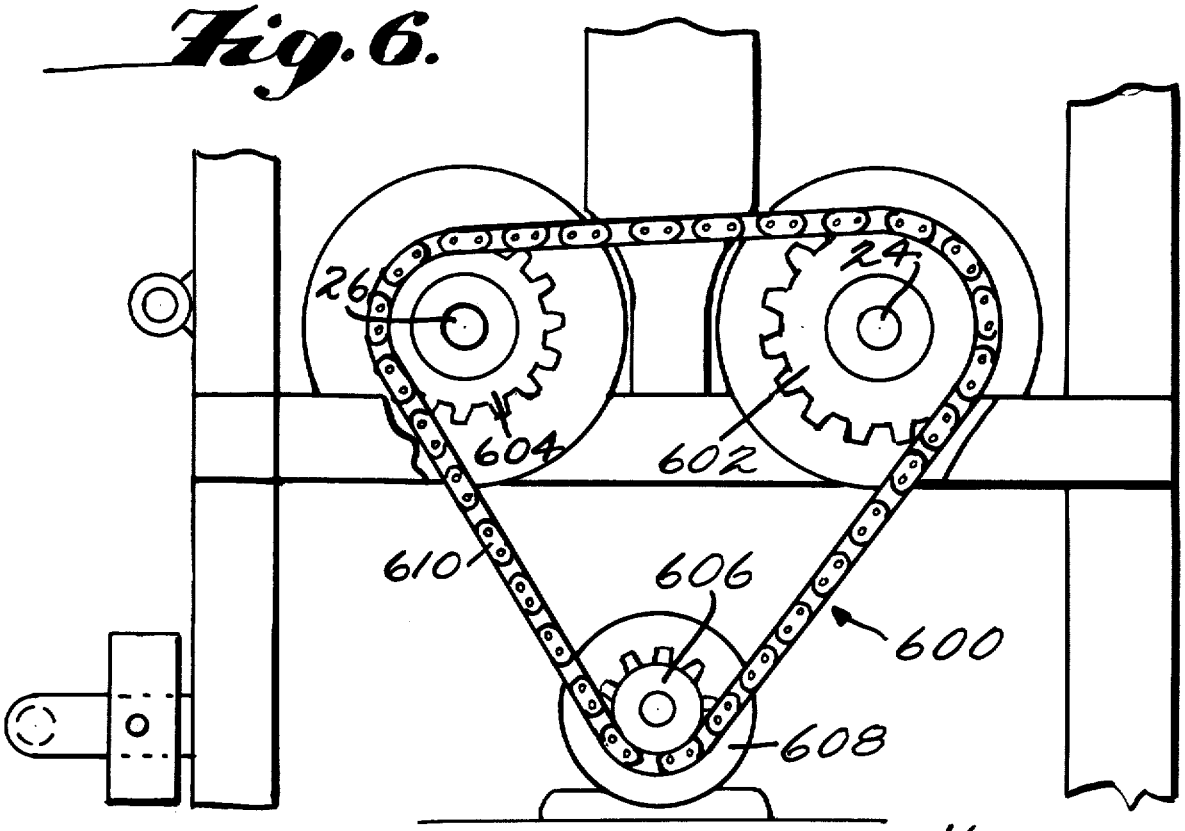
FIG. 6 is a sectional side view of the apparatus in FIG. 2 showing the drive mechanism.

Referring now to FIG. 6, drive mechanism 600 suitably comprises a sprocket gear 602 affixed to shaft 24, a sprocket gear 604 affixed to shaft 26 and sprocket gear 606 affixed to the shaft of a suitable drive motor 608. Gear 602, 604 and 608 are interconnected by a suitable chain 610. A protective enclosure 612 (shown in part in FIG. 1) may also be provided. The gearing ratio is chosen in accordance with the desired speeds of rotation of shafts 24 and 26. For example, gear 602 is suitably a number 40, 15 tooth sprocket, while sprocket gear 604 is suitably a number 40, 20 tooth sprocket. Accordingly, shaft 24 is rotated at a relatively faster speed than shaft 26. The rotation speed is suitably chosen to accommodate the entire anticipated range of ball top windings. For example, the slower speed should be slow enough that undue slack is not created for even the fastest feeding out balls. Suitable speeds for wool sliver are 15 RPM and 20 RPM respectively.

Figure 7:
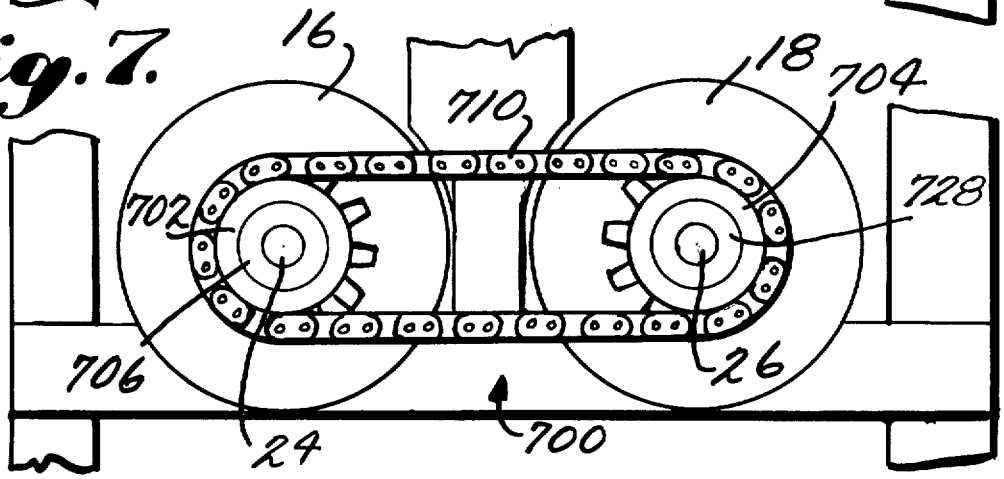
FIG. 7 is a sectional side view showing the coupling mechanism of the rollers in FIG. 2.

Referring now to FIG. 7, coupling mechanism 700 suitably comprises respective sprocket gear 702 and 704 affixed to the ends of roller 16 and 18 respectively, opposite the end at which the respective associate clutch mechanisms 30, 32, are disposed. It should be noted that gears 702, and 704 are coupled to rollers 16 and 18 independently of shafts 24 and 26. Rollers 16 and 18 are rotatably coupled to shaft 24 and 26 by suitable bearings 706 and 708. Sprocket gears 702 and 704 are suitably interconnected by a chain 710. A protective cover 712 (shown in FIG. 1) may be provided to enclose or partially enclose coupling mechanism 700 for saftey purposes.

It should be appreciated that the present invention provides a particularly advantageous apparatus for feeding out a strand or web from a wound collection. A single drive mechanism is used while at the same time individual control for a plurality of wound collections is provided. Further, the creel mechanism of the present invention is particularly suited for feeding out relatively fragile strands such as wool sliver, which may be easily broken. Use of continuously rotating shafts and clutch mechanisms, avoids the inertia encountered when respective motors are started and stopped or in changing the speed of a single motor. Further, by choosing the fast and slow speeds so that the difference therebetween is not great, relatively little jerk is manifested in the strand upon changeover from the slow to fast speeds and visa versa.

If it is desired to more precisely control a lower limit on the tension of the strand, a third common shaft can be added to the system, driven at a speed slightly slower than shaft 26. A respective roller, for each sector would be coaxially disposed on shaft 26 and rotatably mounted thereon, the third roller would typically be disposed between and slightly below roller 16 and 18, preferably so that all three rollers contact ball 12. The third roller would include at one end a sprocket gear and bearing, corresponding to sprocket gears 702, 704 and bearing 706, 708 (FIG. 7). The sprocket would be operatively coupled into coupling mechanism 700 by chain 710 (FIG. 7). Clutch 32 would comprise an electromagnetic clutch rather than the ratchet mechanism of FIGS. 3, 4 and 5. A further electromagnetic clutch would be disposed at the other end of the third roller, to selectively couple the roller to the third shaft. The respective electromagnetic clutches would be actuated in a mutually exclusive manner to selectively drive the set of rollers at a chosen one of the three speeds in accordance with the tension of the strand. Control signals to effect actuation of the clutches can be provided by respective momentary contact switches disposed to be tripped by switch arm 20 when the switch arm is lifted a predetermined distance and drops below a predetermined distance, respectively, from a predetermined position corresponding to the desired tension. Clutch 30 and the third clutch would be directly actuated by the above noted switches. Suitable semiconductor logic circuitry, such as a two input NOR gate receptive of the signals from the switches, controlling a switching transistor, would be used to actuate clutch 32 when neither of the other clutches are engaged. Thus, when the strand tension is within the prescribed tension limits clutch 32 is actuated to rotate the rollers at the middle speed. When the strand is drawn too tight, clutch 30 is actuated to play out the strand at the faster rate. When too much slack in the strand is sensed the third clutch is actuated to drive the rollers at the lowest speed so that slack is drawn up.

It will be understood that the above description is of the preferred exemplary embodiments of the present invention, and the invention is not limited to the specific form shown. For example, clutch 32 could be, if desired a second electromagnetic clutch adapted to be engaged in a mutually exclusive manner with clutch 30. Similarly, belts type drives could be utilized to replace the charge drive mechanisms used in the preferred embodiment and, separate drive mechanisms may be provided, if desired for the respective shafts 24 and 26. These and other modifications may be made in the design and arrangement of the elements without departing from the spirit of the invention as expressed in the appended claims.

What we claim is:

1. Apparatus for controlling the tension of a strand communicating between a wound collection and a utilization device, said apparatus comprising:

a frame;

a plurality of generally parallel rollers, including first and second rollers, rotatably mounted to said frame, adapted to receive said wound collection and impart rotational motion thereto;

coupling means for coupling said first and second rollers such that said first and second rollers rotate at substantially equal speeds;

drive means, responsive to control signals applied thereto, for selectively effecting rotation of said rollers at one of a plurality of predetermined discrete speeds, said drive means comprising: a plurality of shafts rotatably mounted to said frame, each associated with one of said rollers, said associated roller, being coaxially disposed with and rotatably mounted on said shaft; means for rotating each shaft at a different one of said predetermined speeds; and clutch means, responsive to said control signals from said switch means, for operatively coupling for rotation said rollers to the shaft, associated therewith, on a selective mutually exclusive basis; and switch means, responsive to tension in said strand, for controllably generating said control signals to said drive means such that said rollers normally rotate at a specified one of said predetermined speeds, but are rotated at different ones of said predetermined speeds in response to predetermined changes in tension of said strand.

2. The apparatus of claim 1 wherein said first and second rollers include first and second associated shafts rotating at first and second speeds, respectively, said first speed being faster than said second speed; and wherein said clutch means comprises:

an electromagnetic clutch, responsive to said control signals from said switch means, cooperating between said first roller and said first shaft for selectively coupling said first roller to said first shaft for rotation of said first roller at said first speed; and a ratchet mechanism, cooperating between said second roller and said second shaft for coupling said second roller to said second shaft for rotation at said second speed, but being overridden to permit rotation of said second roller independently of said second shaft at said faster first speed in repsonse to said second roller being drive by said coupling means at said first speed upon actuation of said electromagnetic clutch.

3. The apparatus of claims 1 or 2 wherein said switch means comprises:

a switch arm pivotally mounted to said frame, disposed to be pivotally displaced from a predetermined position by said strand in response to said predetermined change in tension in said strand; and at least one momentary contact switch cooperating with said switch arm, disposed for actuation in response to said displacement of said switch arm.

4. Apparatus for controlling the tension of a strand communicating between a utilization device and a wound collection, said apparatus comprising:

first and second rotatable shafts disposed substantially in parallel, separated by a predetermined distance;

means for effecting rotation of said first and second shafts, at a relatively fast speed and a relative slow speed, respectively;

first and second rollers coaxially disposed with said shafts and rotatably mounted thereon, said rollers being adapted to receive said wound collection thereon and impart rotational motion thereto;

means for coupling said rollers such that they rotate at substantially identical speeds;

clutch means, responsive to a control signal applied thereto, for selectively coupling, in a mutually exclusive manner, said first roller to said first shaft to rotate said rollers at said fast speed or couple said second roller to said second shaft to rotate said rollers at said slow speed; and switch means, responsive to tension in said strand, for controllably generating said control signals to said clutch means.

5. The apparatus of claim 4 wherein said clutch means comprises:

an override clutch, responsive to said control signals from said switch means, for selectively coupling said first roller to said first shaft for rotation at said fast speed; and a ratchet mechanism coupled between said second shaft and said second roller, for coupling said second roller to said second shaft for rotation at said slow speed, but being overridden to permit rotation of said second roller independently of said second shaft at said fast speed in response to said second roller being driven by said coupling means at said fast speed upon actuation of said override clutch.

6. The apparatus of claims 4 or 5 wherein said switch means comprises:

a switch arm pivotally mounted to said frame, disposed to be pivotally displaced from a predetermined position by said strand in response to said predetermined change in tension in said strand; and a momentary contact switch, cooperating with said switch arm, disposed for actuation in response to said displacement of said switch arm.

7. Apparatus for providing uniform tension in a predetermined number of strands communicating between utilization means and respective associated wound collection, said apparatus comprising:

a frame;

at least first and second substantially parallel shafts rotatably mounted on said frame;

means for rotationally driving said first shaft at a relatively fast speed and said second shaft at a relatively slow speed, both said first and second shafts being rotated in the same direction;

a respective set of first and second rollers associated with each said wound collection, said first and second rollers being coaxial with said first and second shafts, respectively, and rotatably mounted thereon, said set of rollers being adapted to receive said associated wound collection thereon and impart rotational motion thereto;

a respective coupling means, associated with each said set of rollers, for coupling the rollers of said set such that the first and second rollers of the set rotate at uniform speed;

a respective clutch means associated with each said set of rollers, responsive to control signals applied thereto, for coupling, in a mutually exclusive manner, either said first roller to said first shaft to effect rotation of said set of rollers at said fast speed, or said second roller to said second shaft to effect rotation of said set of rollers at said slow speed; and a respective switch means, associated with each said set of rollers and responsive to tension in the strand communicating with the wound collection received by said set of rollers, for generating control signals to the clutch means associated with said set of rollers.

8. The apparatus of claim 7 wherein said clutch means comprises:

an override clutch, responsive to said control signals from said switch means, for selectively coupling said first roller to said first shaft for rotation at said fast speed; and a ratchet mechanism coupled between said second shaft and said second roller, for coupling said second roller to said second shaft for rotation at said slow speed, but being overridden to permit rotation of said second roller independently of said second shaft at said fast speed in response to said second roller being driven by said coupling means at said fast speed upon actuation of said override clutch.

9. The apparatus of claims 7 or 8 wherein said switch means comprises:

a switch arm pivotally mounted to said frame, disposed to be pivotally displaced from a predetermined position by said strand in response to said predetermined change in tension in said strand; and a momentary contact switch, cooperating with said switch arm, disposed for actuation in response to said displacement of said switch arm.

* * * * *